United States Patent [19]

Stritzl et al.

[11] Patent Number: 4,960,289

[45] Date of Patent: Oct. 2, 1990

[54] ENDPIECE BODY FOR SAFETY SKI BINDINGS

[75] Inventors: Karl Stritzl; Kurt Hoffmann; Henry Freisinger, all of Vienna; Andreas Janisch, Tribuswinkel; Egon Brunnhuber, Vienna; Johann Zotter, Vienna; Egelbert Spitaler, Neudorft; Helmut Wladar, Vienna; Reinhard Muhlberger, Enzersdorf; Karl Dapeci, Harmannsdorf, all of Austria

[73] Assignee: TMC Corporation, Baar/Zug, Switzerland

[21] Appl. No.: 220,032

[22] Filed: Jul. 14, 1988

[30] Foreign Application Priority Data

Jul. 24, 1987 [AT] Austria ..... 1880/87

[51] Int. Cl.[5] ..... A63C 9/08

[52] U.S. Cl. ..... 280/630

[58] Field of Search ..... 280/629, 630, 628, 626

[56] References Cited

U.S. PATENT DOCUMENTS

| | | | |
|---|---|---|---|
| 3,625,535 | 12/1971 | Oehlmann | 280/630 |
| 3,909,030 | 9/1975 | Beyl | 280/630 |
| 4,095,821 | 6/1978 | Salomon | 280/630 X |

FOREIGN PATENT DOCUMENTS

| | | | |
|---|---|---|---|
| 225587 | 1/1963 | Austria | 280/630 |
| 4035 | 5/1982 | Austria . | |
| 4036 | 5/1982 | Austria . | |
| 375269 | 5/1982 | Austria . | |
| 368396 | 10/1982 | Austria . | |
| 1943973 | 8/1969 | Fed. Rep. of Germany . | |
| 2259819 | 12/1972 | Fed. Rep. of Germany . | |
| 7880 | 1/1984 | Fed. Rep. of Germany . | |
| 2537442 | 12/1982 | France . | |
| 2556602 | 12/1983 | France . | |

*Primary Examiner*—Richard A. Bertsch
*Assistant Examiner*—Michael Mar
*Attorney, Agent, or Firm*—Finnegan, Henderson, Farabow, Garrett & Dunner

[57] ABSTRACT

An endpiece for a safety ski binding attached to a ski, the endpiece comprising an elongated housing for disposition on the ski in the longitudinal direction of the ski; a lever pivotably mounted to the housing, the lever including a first end having a bolt opening and a second end; a sole holder for exerting a downward force on the sole of a ski boot, and having a portion disposed beneath the lever, the sole holder also having an elongated bore extending substantially perpendicular to the longitudinal axis of the ski; a bolt extending through the bolt opening and the bore, the sole holder vertically slidable on the bolt; a first spring disposed between the housing and the sole holder for urging the sole holder toward the ski; and a second spring for exerting a force on the second end of the lever for resisting rotational movement of the first and of the lever away from the ski.

6 Claims, 7 Drawing Sheets

ENDPIECE BODY FOR SAFETY SKI BINDINGS

BACKGROUND OF THE INVENTION

1. Field of the Invention

The invention relates generally to an endpiece body for a safety ski binding and relates specifically to an endpiece body including an automatically adjustable sole holder.

2. Description of Related Art

An endpiece body has already been described in Austrian Patent Specification No. 375,269. In this endpiece body, the sole holder, which can be turned in a horizontal plane, can also be pivoted to a limited extent in a vertical plane on a transverse pivot which penetrates through the bolt. The flat rear side of the sole holder is acted upon via a piston by the release spring, which attempts to pivot the lever arm of the sole holder remote from the spring against the upper side of the ski.

This endpiece body has the disadvantage that the sole thickness may only have a slight clearance to enable the sole holder to provide satisfactory fixing. In addition, manufacturing the sole holder is difficult insofar as a bore which runs at an oblique angle to the upper and lower boundary surface and is roughly in the shape of an elongated hole in plan view penetrates through this sole holder.

German Offenlegungsschrift No. 1,943,973 describes another endpiece body. This endpiece body can be pivoted about a pivot running perpendicularly to the upper side of the ski and is fastened in the travel position by means of an adjustable catch device. On the side opposite the catch device with respect to the pivoting axis, the endpiece body has a vertical bore in which a sleeve having an internal thread is located. Screwed into this sleeve is a further threaded sleeve through which a screw bolt supporting a sole holder penetrates. Located between the nut of the screw bolt and the second threaded sleeve is a helical spring which presses down the sole holder.

If there is snow beneath the sole, the sole holder is lifted and the compression spring supporting the screw bolt is compressed slightly. This endpiece body is also complicated in its construction.

In FIGS. 7 and 8 of German Offenlegungsschrift No. 2,259,819, a front endpiece is shown in which a sole holder which is under the effect of a spring pressing it upward is displaceably guided on a bolt. In two diametrically opposite areas, the bore of the sole holder has threaded segments which extend over about 90°. The bolt is flattened on two sides and has between the flattened areas threaded segments which likewise extend over about 90°. By turning the bolt through 90°, the threaded segments of bolt and bore can be released from one another for the adjusting operation (see FIG. 8) and can be brought into engagement again with one another for fixing the sole holder in position (see FIG. 7). Automatic adjustment of the sole holder is thus not possible in this embodiment. On the contrary, the position of the sole holder desired in each case must be set manually, as described.

SUMMARY OF THE INVENTION

According it is an object of the invention to remove the disadvantages of the known embodiments and to create an endpiece body which on the one hand is simple in its construction and on the other hand permits automatic setting of the sole holder even if the thickness of the sole varies within prescribed tolerance limits (see at present Austrian Standard Specification ÖNORM S 4035 or West German Standard Specification DIN 7880, part 1: 19±1 mm for adults, and ÖNORM S 4036 or DIN 7880, part 2: 15±2 mm for children).

Based on an endpiece body according to the present invention, this object is achieved according to the invention. By means of present invention, automatic adaption of the distance of the sole holder from the lower section of the housing or the supporting body or the upper side of the ski is ensured even if ski boots having soles of different thicknesses are inserted into the endpiece body.

Further according to the present invention, the overall height of the endpiece body is reduced, especially since part of the length of the compression spring is located inside the sole holder.

Further according to the present invention, it is ensured that on the one hand the sole holder is pressed with adequate force against the inserted ski boot, but that this pressure is not so great that an effect on the pretension of the release spring is caused.

Further according to the present invention, the sole holder is secured in position in the endpiece body in a simple manner.

Further the construction according to the invention can be advantageously used in various types of endpiece bodies.

The present invention thus relates to the use of an endpiece body according to the invention in a safety ski binding having a compensating lever as described, for example, in Austrian Patent Specification No. 368,396 and which enables friction forces which additionally occur at the sole holder in the event of a backward twisting fall to be compensated. In this endpiece body, although an elastic element is arranged between the sole holder and the compensating lever, this elastic element is merely used to permit a pivoting movement of the compensating lever without the sole holder changing its vertical position. The vertical position of the release lever is not affected by the elastic element. The arrangement of a helical spring is especially favorable for manufacturing reasons.

Further according to the present invention, the sole holder is secured against swinging out laterally.

Further according to the present invention, it is expressed that the measure according to the invention can also be used advantageously in heel endpieces.

The distance between the sole holder and the underside of the housing, which distance is automatically set in each case by the ski boot via the helical spring, is essentially determined by the present invention.

The set position of the sole holder is ensured by the present invention.

It follows from the present invention that the principle according to the invention can also be used in front endpieces which are known per se and in which the housing supporting the sole holder is mounted on a bearing block. Accordingly, the bolt which forms the pivoting axis for the housing and is under the effect of the helical spring is mounted in an axially displaceable manner in the bearing block.

In contrast thereto, a front endpiece may be provided in which the bolt which forms the pivoting axis for the housing, as likewise known, is secured in the bearing block against axial displacement and in which the housing is displaceably guided on the bolt in a vertical direction.

BRIEF DESCRIPTION OF THE DRAWINGS

FIG. 1 is a vertical longitudinal center section of a front endpiece of a ski binding embodying the teachings of a first embodiment of the present invention;

DETAILED DESCRIPTION OF THE PREFERRED EMBODIMENTS

Figure 1A:
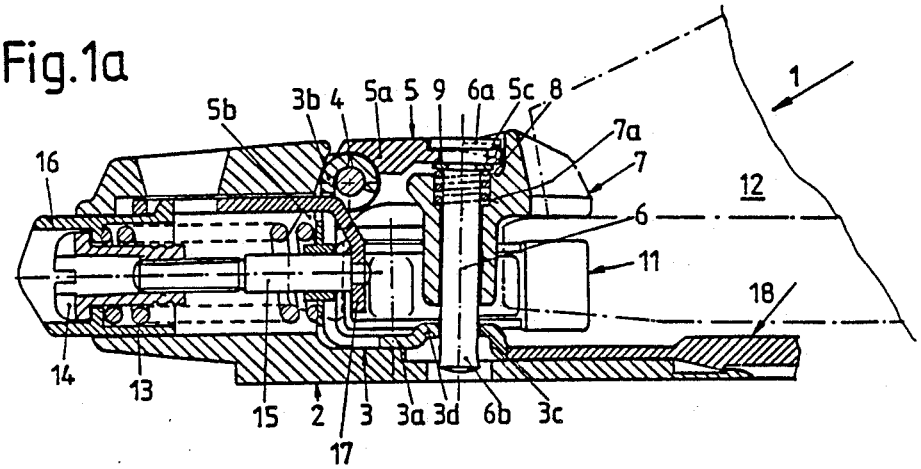
FIG. 1*a* depicts the endpiece of FIG. 1 at the beginning of a rearward fall.

An endpiece body shown in FIGS. 1–4 is designed as a front endpiece and is designated overall by 1. Endpiece 1 has a housing 2 which can be fixed in a known manner by means of screws (not shown) to the upper side of a ski (not shown) and in which a supporting body 3 is arranged which is roughly angular in longitudinal section. Of the latter, one leg 3*a* is arranged substantially parallel to the upper side of the ski. The other leg 3*b* runs vertically relative to the upper side of the ski and carries at its upper end a pivot 4 which runs in the transverse direction of the ski and parallel to the upper side of the ski. A bell-crank lever 5 is mounted on this pivot 4. Recessed in the leg 5*a* of the bell-crank lever 5 running parallel to the leg 3*a* of the supporting body 3 is a vertical bore 5*c* through which a bolt 6 penetrates whose head 6*a* rests on the leg 5*a*. The lower end of the bolt 6 is guided in a bore 3*c* of the leg 3*a*. The bore 3*c* is located in a cup-shaped bulge 3*d* of the leg 3*a*. The lower end of the bolt 6 is provided with a widened section 6*b* which limits the displacement travel of the bolt 6 and thus the pivoting angle of the bell-crank lever 5.

Figure 1B:
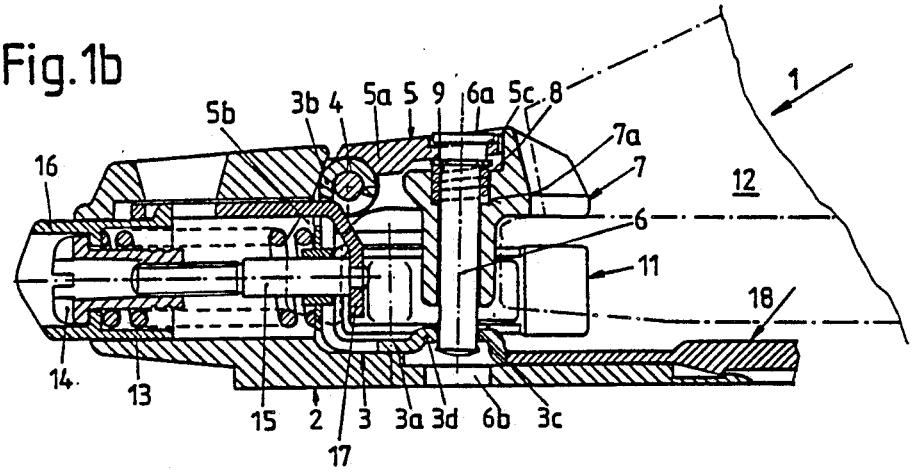
FIG. 1*b* depicts the endpiece of FIG. 1 during a rearward fall and before the release movement begins.
Figure 1C:
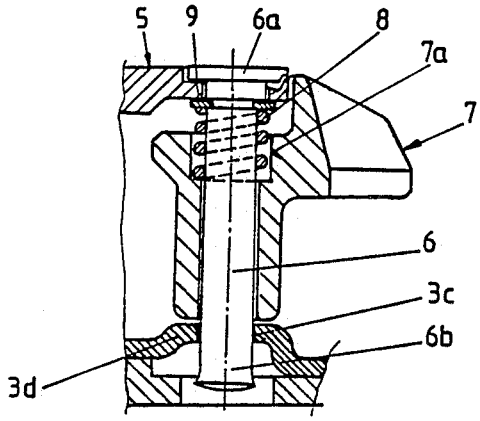
FIG. 1*c* depicts the endpiece of FIG. 1 showing an enlarged view of the bolt and sole holding means.
Figure 2:
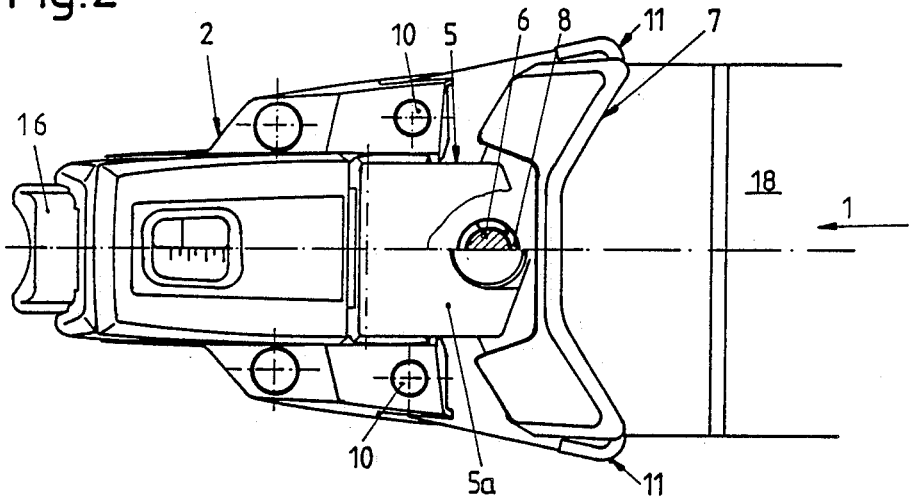
FIG. 2 is a partially sectioned plan view of the endpiece illustrated in FIG. 1.

The bolt 6 penetrates through the stepped bore 7*a* of a sole holder 7 which, when a ski boot is not inserted, rests on the bulge 3*d* of the leg 3*a*, as shown in FIG. 1. Furthermore, the bolt 6 is surrounded by a helical spring 8 which, with its lower end, is arranged in the stepped bore 7*a* and, with the other, upper end, is supported against the underside of the leg 5*a*, for example by a lock washer 9 in betweeen which engages into a groove of the bolt 6. Clearance enabling the bell-crank lever 5 to pivot is present between the lock washer 9 and the underside of the leg 5*a*.

Figure 3:
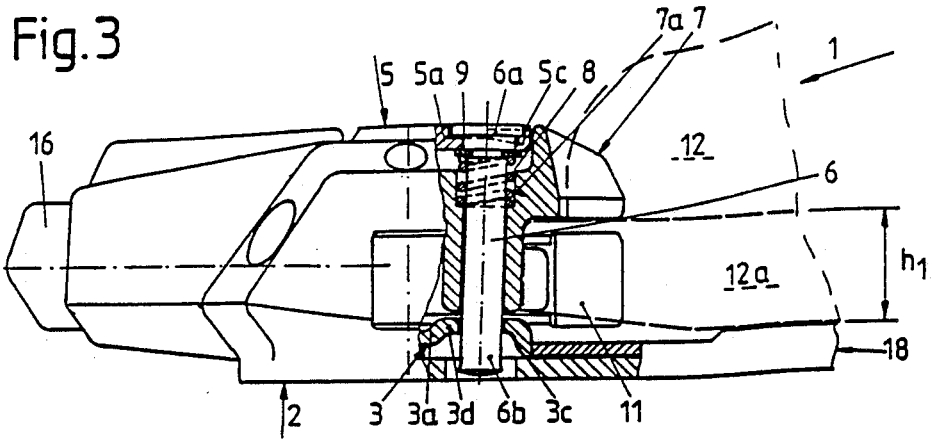
FIGS. 3 and 4 are partially sectioned side views of the endpiece illustrated in FIG. 1 with inserted thin and thick soles, respectively.
Figure 4:
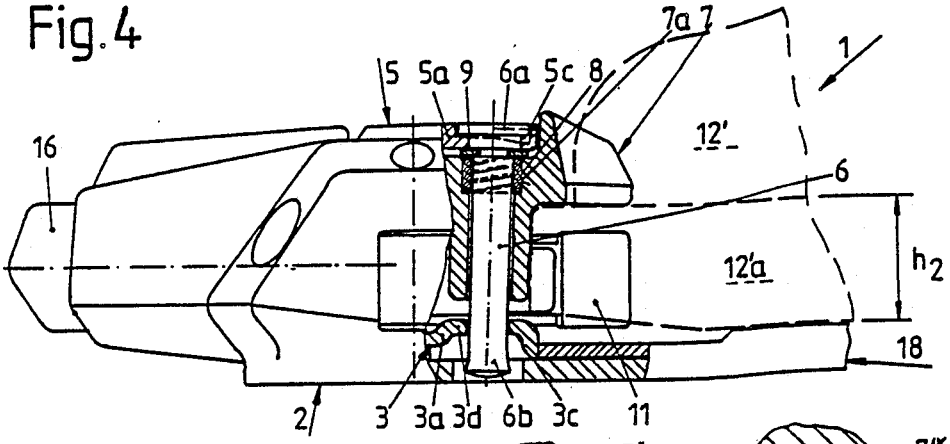

The remaining construction 3*a* of the front endpiece 1 is of a known type. Thus, the leg 3*a* of the supporting body 3, at a lateral distance from the vertical longitudinal center plane of the front endpiece 1, carries two vertical pivots 10 on which lateral bell-crank levers 11 are mounted, of which one leg serves to laterally hold the sole 12*a*, 12'*a* of a boot 12, 12' inserted into the front endpiece 1 as shown in FIGS. 3 and 4.

A release spring 13 extending in the longitudinal direction of the endpiece 1, is accommodated in the housing 2. The pretension of the release spring 13 can be set by means of a sleeve 14 having an internal thread. This sleeve 14 is screwed onto the threaded section of a tie rod 15 which penetrates centrally through the release spring 13. Supported on a collar of the sleeve 14 is a further sleeve 16 which performs the function of a spring plate. On its end adjacent to the ski boot, the tie rod 15 carries a slide 17. A pull toward the ski tip is exerted on the slide 17 by the release spring 13 via the tie rod 15. The slide 17 acts on each of the two lateral bell-crank levers 11 and, via the latter, the bell-crank lever 5.

In FIG. 1, the front endpiece 1 is represented before insertion of the ski boot. If the ski boot is to be inserted, the tip of the sole 12*a* or 12'*a*, tapered roughly in a wedge shape, is inserted obliquely from above into the gap between the leg 3*a* of the supporting body 3 and the sole holder 7. The ski boot 12 or 12' is then kicked downward so that it rests with its sole 12*a* or 12'*a* on the leg 3*a* or on a base plate 18, as shown in FIGS. 3 and 4. As a result, the sole holder 7 is lifted against the force of the helical spring 8 in accordance with the thickness of the sole 12*a* or 12'*a*. This position of the sole holder 7 is shown in FIG. 3 when a ski boot is used whose sole 12 has a thickness $h_1$ and in FIG. 4 when a ski boot is used whose sole 12'*a* has a thickness $h_2$.

Figure 5:
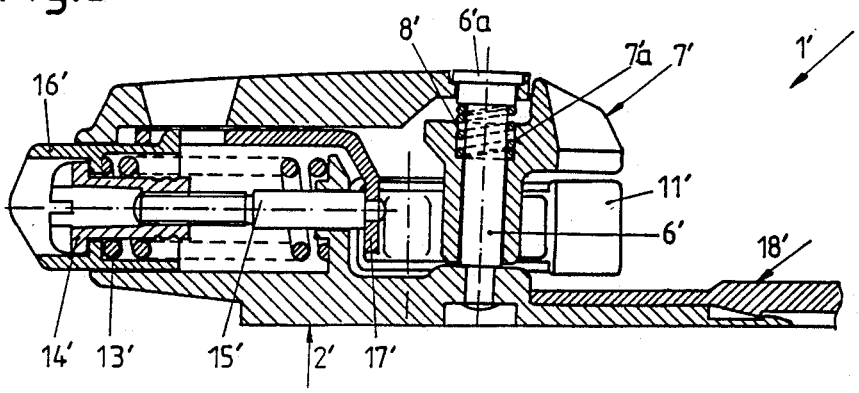
FIG. 5 is a vertical longitudinal center section of a front endpiece of a ski binding embodying the teachings of a second embodiment of the present invention.

The front endpiece 1' shown in FIG. 5 is very similar to endpiece 1 described above. It differs from the latter merely in that the head 6'*a* of the bolt 6' is mounted in the housing 2' itself and that the release spring 13' accommodated in the housing 2' only acts on the two lateral bell-crank levers 11', which are intended for laterally holding the sole. Although this embodiment is slightly simpler in its construction than the embodiment described above, it has the disadvantage that friction forces which occur at the sole holder in the event of a twisting fall backward are not compensated in it.

Figure 6A:
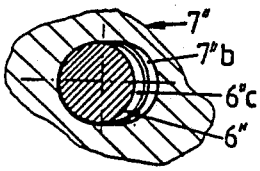
FIG. 6*a* is an enlarged section along the line VI*a*–VI*a* in FIG. 6.
Figure 6B:
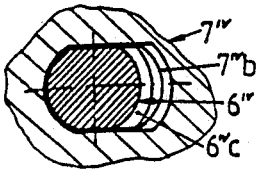
FIG. 6*b* is a variant of the endpiece illustrated in FIG. 6*a*.
Figure 6:
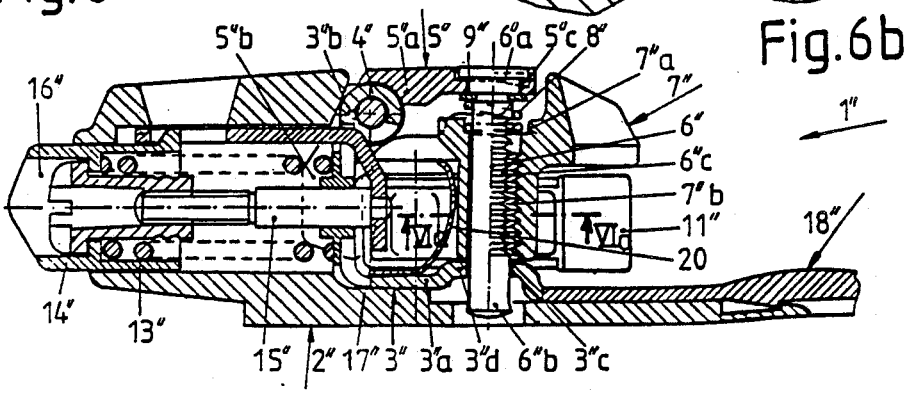
FIG. 6 is a longitudinal center section of a front endpiece of a ski binding embodying the teachings of a third embodiment of the present invention.
Figure 7:
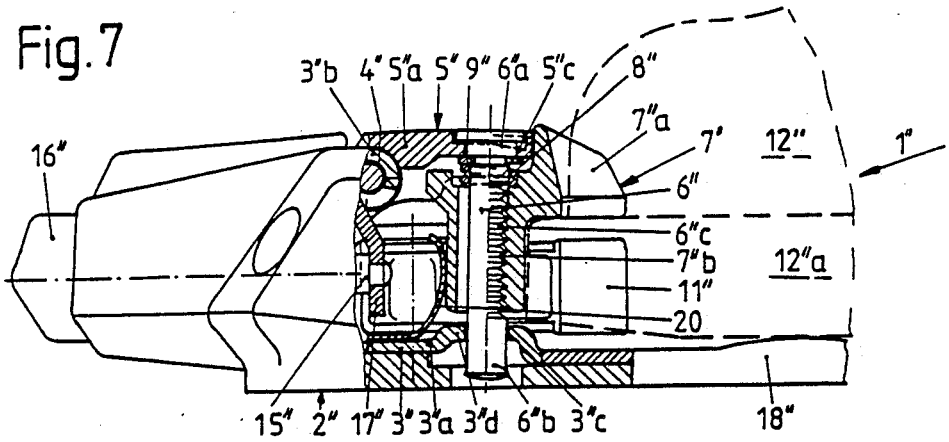
FIG. 7 is a partially sectioned side view of the endpiece illustrated in FIG. 6 with an inserted sole.

The front endpiece 1" according to FIGS. 6 and 7 essentially corresponds to the front endpiece 1 according to FIGS. 1–4. It differs from the latter merely in that the bolt 6", in the region of the half of its peripheral surface facing away from the release spring 13", is provided with ribs 6"*c* which run normal to the bolt axis and in the peripheral direction of the bolt 6" and are roughly crescent-shaped in plan view and opposite which are located corresponding grooves 7"*b* in the associated half of the roughly elliptical bore of the sole holder 7". The side of the sole holder 7" facing the release spring 13" is acted upon by a leaf spring 20 fixed with one end to the supporting body 3", as a result of which the ribs 6"c are disengaged from the grooves 7"b of the sole holder 7", as shown in FIG. 6.

If, however, the ski boot 12", with its sole 12"a, is inserted into the front endpiece 1", the leaf spring 20—after the sole holder 7" has automatically adapted itself to the thickness of the sole 12"a—is bent back and the ribs 6"c of the bolt 6" engage into the grooves 7"b of the sole holder 7", which is thereby secured in its vertical position relative to the base plate 18", as shown in FIG. 7.

FIG. 6a illustrates to an enlarged scale the configuration of the ribs 6"c of the bolt 6" and the grooves 7"b of the sole holder 7". Here, it should be noted that the sole holder 7" can be displaced in the vertical direction relative to the bolt 6".

The variant of a sole holder $7^{IV}$ according to FIG. 6b differs from the above described embodiment that the bolt $6^{IV}$ following the ribs $6^{IV}c$, is laterally flattened and the sole holder $7^{IV}$ has guide sections corresponding to the flattened sections. The sole holder $7^{IV}$ is thereby secured against swinging out laterally.

In contrast to the exemplary embodiments described above in connection with FIGS. 1–7, FIGS. 8 and 9 refer to an endpiece body which is desgined as a heel holder 30. This heel holder 30 has a bearing block 31 which can be displaced on a guide rail 32 in the longitudinal direction of the ski and can be locked in a known manner in the position selected by means of a catch device (not shown). Located in the bearing block 31 at the end remote from the sole holder 7''' is a transverse pivot 33 on which the housing 2''', approximately U-shaped in cross section and carrying a tread spur 35 and the sole holder 7''', is pivotably mounted. Fixed in the housing 2''' is a pivot 36 which forms the pivoting axis for a release lever 37. The heel holder 30 can be opened at will in a known manner by a transversely running pin 38 which is attached to the release lever 37 and penetrates through elongated holes (not shown) in the housing 2'''.

Figure 8:
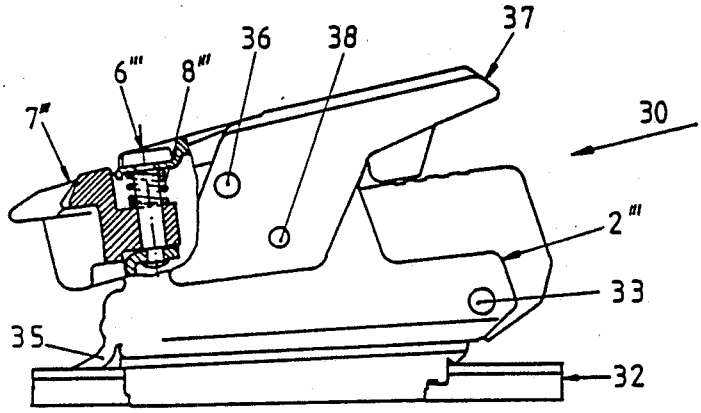
FIGS. 8 and 9 illustrate a partially sectioned side view of a heel holding endpiece embodying the teachings of a fourth embodiment of the present invention in a state of rest and during the entering operation.

Fixed in the housing 2''' is a bolt 6''' which runs approximately normal to the guide rail 32 in the position according to FIG. 8 and on which the sole holder 7''' is displaceably guided. The sole holder 7''' is pressed by the helical spring 8''' toward the upper side of the heel 12'''.

The remaining components of the heel holder 30 are of a known type of construction, for which reason the arrangement of the release spring, the control lever, the spring fork and the cam allocated to the control lever is not dealt with in greater detail.

Figure 9:
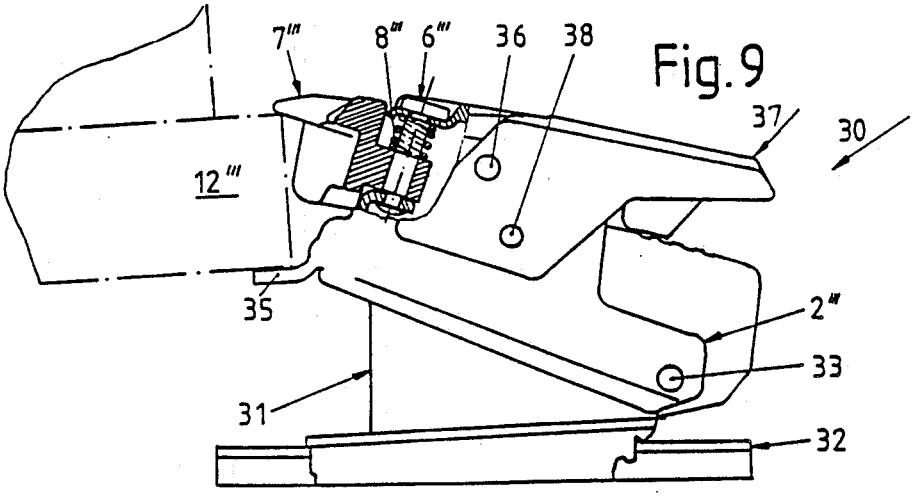

Whereas in the design of the endpiece body as a front endpiece, as illustrated in FIGS. 1–7 and 10–14, the sole holder is lifted during the entering operation by the sole tip tapered in a wedge shape, this is not possible in a heel holder 30 as shown in FIGS. 8 and 9. Here, during the entering operation, the ski boot already inserted into the front endpiece and the housing 2''' mounted on the transverse pivot 33 and supporting the sole holder 7''' executes oppositely directed pivoting movements by which the heel 12''' of the ski boot is inserted in a sloping position into the gap between the sole holder 7''' and the tread spur 35, as shown in FIG. 9. As a result, the sole holder 7''' is lifted slightly against the force of the helical spring 8'''. Consequently, it is also possible to fasten with the heel holder 30 heels whose height exceeds the currently permissible distance between the tread spur 35 and the sole holder 7''' (see the standard specifications cited above.

Figure 10:
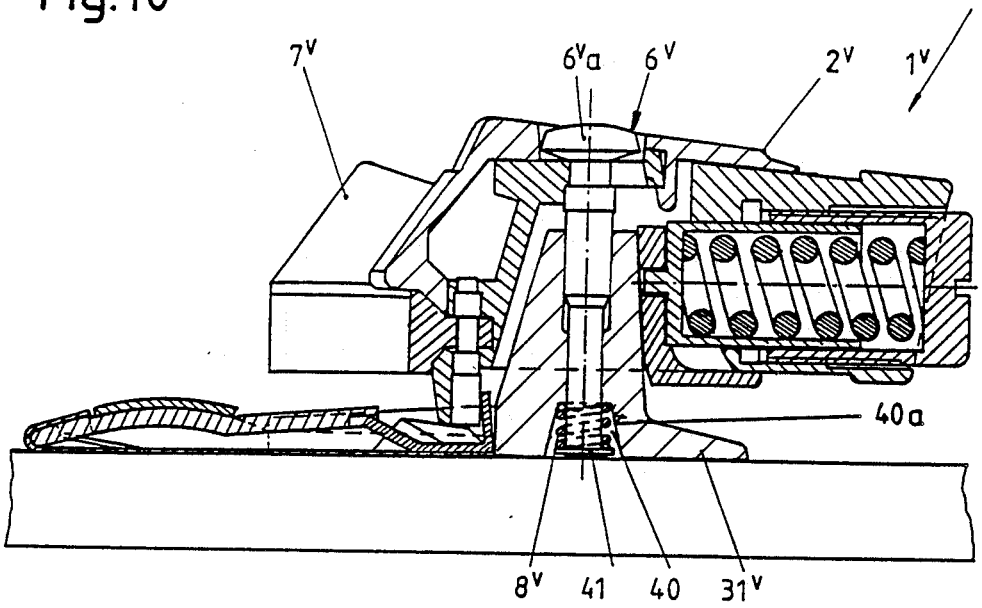
FIGS. 10 and 11 are vertical longitudinal center sections of front endpieces embodying the teachings of a fifth embodiment of the present invention.
Figure 11:
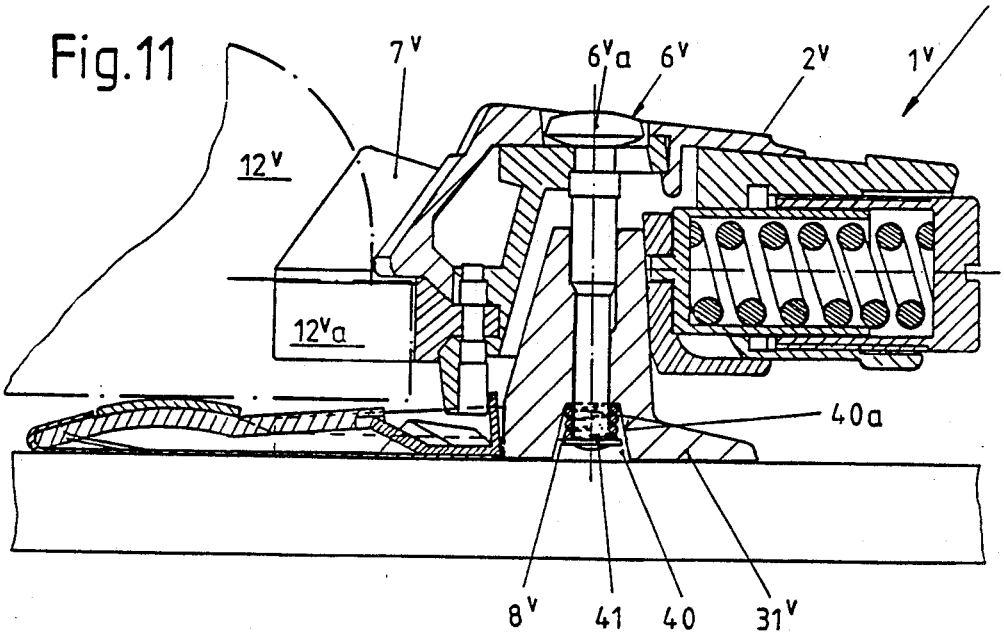

The front endpiece $1^{V}$ according to FIGS. 10 and 11, in contrast to the front endpieces described above has a bearing block $31^{V}$ which is to be fixed on the upper side of the ski and in which the bolt $6^{V}$ is mounted in a vertically displaceable manner. The bearing block $31^{V}$ has in its lower area a truncated-cone-shaped recess 40, open at the bottom, into which the lower end of the bolt $6^{V}$ protrudes. Arranged on this end is the helical spring $8^{V}$, which is supported with one end against the roof 40a of the recess 40 and with its other end against a washer 41 which is slipped onto the bolt $6^{V}$ and is riveted to the latter.

The rest of the construction of the front endpiece $1^{V}$ is known per se (see French patent specification No. 2,537,442). Thus the bolt $6^{V}$ has on its upper end a head $6^{V}a$ which is used for mounting the housing $2^{V}$ which is provided with a sole holder $7^{V}$ at its rear end. The housing $2^{V}$ can not only be pivoted laterally about the bolt $6^{V}$ but can also be pivoted vertically, especially as the underside of the head $6^{V}a$ is of conical design.

During the entering operation, the end of the sole $12^{V}a$ of the ski boot $12^{V}$ is pushed beneath the sole holder $7^{V}$ and then the ski boot is pivoted toward the ski. As a result, the housing $2^{V}$ is lifted slightly and the helical spring $8^{V}$ is compressed, as shown in FIG. 11. It is therefore not necessary to set the height of the housing $2^{V}$ manually.

Figure 12:
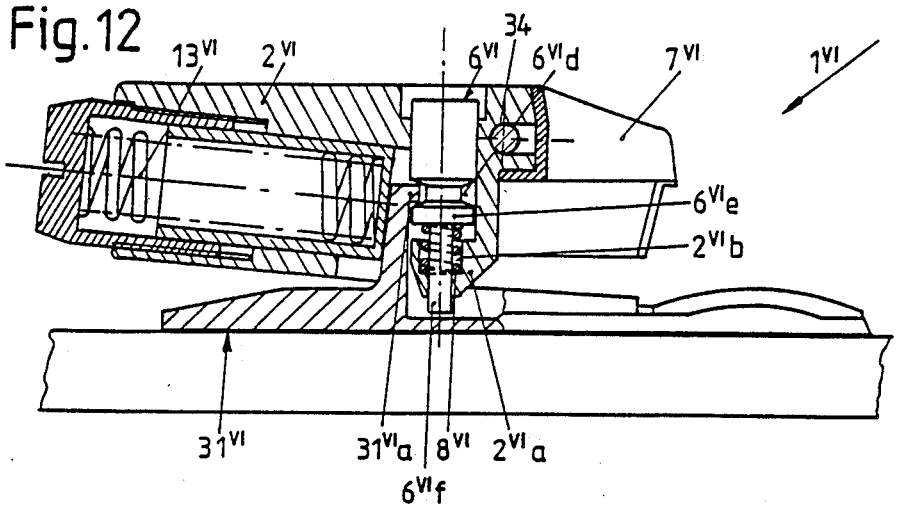
FIGS. 12 and 13 are vertical longitudinal center sections of front endpieces embodying the teachings of a sixth embodiment of the present invention.
Figure 13:
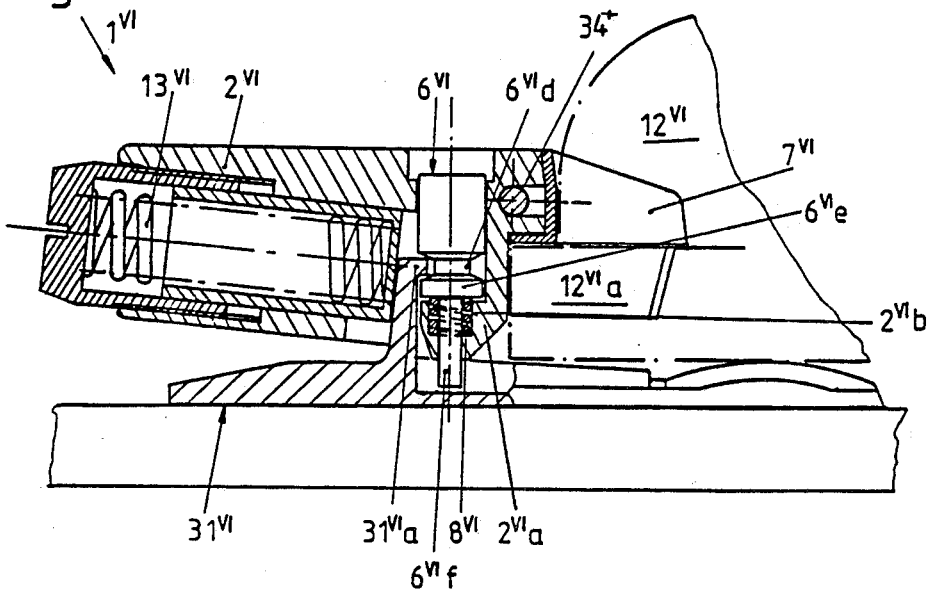

The front endpiece $1^{VI}$ shown in FIGS. 12 and 13 essentially consists of a bearing block $31^{VI}$ and a housing $2^{VI}$ supporting the sole holder $7^{VI}$ and accommodating the release spring $13^{VI}$. The bolt $6^{VI}$ is displaceably mounted in the housing $2^{VI}$ against the force of the helical spring $8^{VI}$. In its center area, the bolt $6^{VI}$ has an annular groove $6^{VI}d$ which is defined by a collar $6^{VI}e$ and into which an extension $31^{VI}a$ of the bearing block $31^{VI}$ radially engages. The bearing bore for the upper end of the bolt $6^{VI}$ is recessed in the housing $2^{VI}$ itself, whereas the lower bearing bore, designed as a stepped bore $2^{VI}b$, is located in an extension $2^{VI}a$ of the housing $2^{VI}$.

The helical spring $8^{VI}$ is arranged on the tapered, lower end $6^{VI}f$ of the bolt $6^{VI}$ adjoining the collar $6^{VI}e$. The upper end of the helical spring $8^{VI}$ is supported on the collar $6^{VI}e$ of the bolt $6^{VI}$, whereas the lower end is supported by the step of the stepped bore $2^{VI}b$ in the extension $2^{VI}a$ of the housing $2^{VI}$ and is surrounded by this extension $2^{VI}a$.

In the housing $2^{VI}$, a threaded pin 34 running in the transverse direction of the front endpiece $1^{VI}$ is rotatably mounted in its center area but is secured against axial displacement. In its two end areas, the threaded pin 34 has oppositely directed threaded sections which engage into nuts (not shown). The latter are rotatably mounted in levers (not visible) which laterally enclose the sole $12^{VI}a$. These levers merely serve to laterally fasten the sole $12^{VI}a$. However, they cannot be swung out laterally in the event of a twisting fall by the skier. On the contrary, the lateral swing-out movement is effected by the housing $2^{VI}$ in the event of a twisting fall.

The remaining constructional elements of the front endpiece $1^{VI}$ are known (see French Patent Specification No. 2,556,602) and are not a subject matter of the present invention, for which reason their description is dispensed with.

Figure 14:
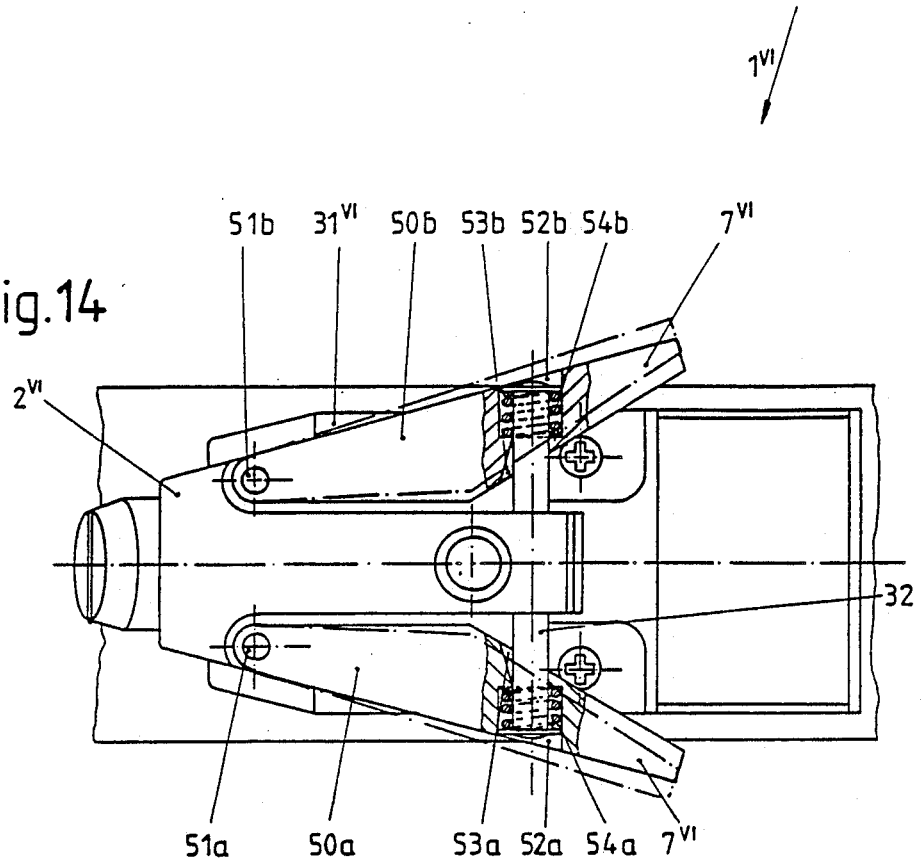
FIG. 14 is a plan view of the endpiece illustrated in FIG. 12.

FIG. 14 represents a variant of the embodiment in FIGS. 12 and 13. This variant is distinguished by the fact that a smooth bolt 34' and not a threaded pin penetrates through the two levers 50*a*, 50*b* which laterally enclose the sole $12^{VI}a$. The levers 50*a*, 50*b* are mounted on vertical pivots 51*a*, 51*b* which are anchored with their lower ends in the housing $2^{VI}$. At a distance from the two vertical pivots 51*a*, 51*b*, stepped bores 52*a*, 52*b* running in the transverse direction are recessed in the levers 50*a*, 50*b*, which stepped bores 52*a*, 52*b* merge into conical widened sections 53*a*, 53*b* toward the vertical longitudinal center plane of the front endpiece. Helical springs 54*a*, 54*b* are accommodated in the two stepped bores 52*a*, 52*b*. Each helical spring 54*a* or 54*b* is supported with one end against the step of the stepped bore 52*a* or 52*b* and with the other end against a washer 55*a* or 55*b* which is riveted onto the end of the bolt 34'.

In this embodiment too, the housing $2^{VI}$ is pivoted about the bolt $6^{VI}$ in the event of a twisting fall by the skier, whereas the two levers 50*a*, 50*b* essentially do not change their position relative to the housing $2^{VI}$.

Various changes to the exemplary embodiments shown are possible without leaving the scope of the invention. For example, the sole holder, in the rest position, need not necessarily be supported on the supporting body or on the housing; on the contrary, it can also be supported on a washer or on an intermediate sleeve which surrounds the bolt with clearance and rests on the supporting body or on the housing. Furthermore, it is possible to design the sole holder roughly in a V-shape in plan view. In this case, the two legs of the V exert a downward pressure on the sole to both sides of the vertical longitudinal center plane of the ski boot. Finally, the spring elements, which in all exemplary embodiments are shown as helical springs, can be formed by disk spring stacks, or plastic or rubber elements. In this case, the pretension of the spring elements is 5°–90° of the pretension of the release spring.

What is claimed is:

1. An endpiece for a safety ski binding attached to a ski, the endpiece comprising:

an elongated housing for disposition on the ski in the longitudinal direction of the ski;

a base plate having an opening disposed therein;

a lever pivotably mounted to said housing, said lever including a first end having a bolt opening and a second end;

sole holding means for exerting a downward force on the sole of a ski boot, and having a portion disposed beneath said lever, said sole holding means also having an elongated bore extending substantially perpendicular to the longitudinal axis of the ski;

a bolt having an enlarged head portion and an elongated smooth main portion, said head portion being received within said bolt opening, said main portion extending through said bore and said opening in said base plate, said bolt being axially moveable in said opening of said base plate in response to pivotal movement of said lever, said sole holding means being vertically slidable on said main portion of said bolt between a first position substantially abutting said lever and a second position substantially abutting said base plate;

locking means for locking said head portion of said bolt within said bolt opening;

first biasing means disposed on said bolt between said lever and said sole holding means for urging said sole holding means to said second position; and second biasing means for exerting a force on said second end of said lever for urging said first end of said lever toward said base plate.

2. An endpiece as set forth in claim 1 wherein said first biasing means includes a helical spring and said elongated bore includes a stepped portion for receiving said spring.

3. An endpiece as set forth in claim 1 wherein the pretension of said first biasing means is 5–90% of the pretension of said second biasing means.

4. An endpiece as set forth in claim 1 wherein said bolt is substantially flattened in its center area and wherein said sole holding means includes guide sections corresponding to said substantially flattened area of said bolt.

5. An endpiece as set forth in claim 1 further comprising means for limiting the pivotal movement of said lever.

6. An endpiece as set forth in claim 1 further comprising a supporting body for supporting said housing, said supporting body including a bolt end opening for receiving the lower end of said bolt, said lower end of said bolt having a widened end portion larger than said bolt end opening to prevent said bolt from being removed from said opening.

* * * * *